US005915431A

United States Patent [19]

Doussan

[11] Patent Number: 5,915,431

[45] Date of Patent: Jun. 29, 1999

[54] POOL CLEANING APPARATUS

[76] Inventor: Herman A. Doussan, 4516 Lefkoe St., Metairie, La. 70006

[21] Appl. No.: 08/828,617

[22] Filed: Mar. 31, 1997

Related U.S. Application Data

[63] Continuation-in-part of application No. 08/565,710, Nov. 30, 1995, abandoned.

[51] Int. Cl.[6] ..... E04H 4/16

[52] U.S. Cl. ..... 15/1.7; 210/169; 210/241; 210/470; 210/471; 248/99; 294/1.1; 294/19.2

[58] Field of Search ..... 15/1.7, 257.1, 15/257.3, 257.9, 257.7; 210/169, 241, 470, 471; 248/99; 414/440; 294/1.1, 1.4, 19.2

[56] References Cited

U.S. PATENT DOCUMENTS

| | | | |
|---|---|---|---|
| D. 259,936 | 7/1981 | Price . | |
| 1,167,782 | 1/1916 | Richards | 294/1.1 |
| 2,902,705 | 9/1959 | Eistrup | 15/1.7 |
| 3,073,727 | 1/1963 | Mullinix | 15/1.7 |
| 3,547,458 | 12/1970 | Price . | |
| 3,861,730 | 1/1975 | Ringo | 294/1.4 |
| 4,003,100 | 1/1977 | Whitaker | 15/1.7 |
| 4,019,768 | 4/1977 | Niece | 15/257.7 |
| 4,138,153 | 2/1979 | Brown | 15/257.1 |
| 4,152,801 | 5/1979 | Lieber | 210/470 |
| 4,279,437 | 7/1981 | Goldbarg | 294/1.4 |
| 4,338,697 | 7/1982 | Broadwater | 15/1.7 |
| 4,442,567 | 4/1984 | Pravettone | 248/99 |
| 4,692,956 | 9/1987 | Kassis | 15/1.7 |
| 4,835,810 | 6/1989 | Hugo | 15/1.7 |
| 5,031,277 | 7/1991 | Coker | 15/257.1 |
| 5,040,754 | 8/1991 | Dearman | 294/1.1 |
| 5,044,034 | 9/1991 | Iannucci | 15/1.7 |
| 5,050,920 | 9/1991 | Potticary | 294/1.1 |
| 5,074,004 | 12/1991 | Patton | 15/1.7 |
| 5,249,324 | 10/1993 | Giammanco | 15/1.7 |

FOREIGN PATENT DOCUMENTS

| | | | |
|---|---|---|---|
| 1289567 | 9/1972 | United Kingdom | 294/1.1 |

*Primary Examiner*—Randall E. Chin
*Attorney, Agent, or Firm*—Morgan & Finnegan LLP

[57] ABSTRACT

A pool cleaning apparatus includes a head having a forward portion and a rearward portion, a debris reservoir detachably connected to the rearward portion or the head, a first deflectable blade detachably connected to a lower end of the forward portion of the head, and being movable downwardly to engage a surface of the pool in response to water flow in the direction of the debris reservoir, and a bracket for connecting a handle to the head.

7 Claims, 11 Drawing Sheets

POOL CLEANING APPARATUS

This is a continuation-in-part of Ser. No. 08/565,710 filed Nov. 30, 1995, now abandoned.

FIELD OF THE INVENTION

The present invention relates generally to devices and methods for cleaning debris from swimming pools, and more specifically, to non-motorized, manually powered devices capable of riding on pool surfaces, including the floor and sidewalls, to collect non-buoyant debris.

BACKGROUND OF THE INVENTION

In warm weather states, people use outdoor pools most months of the year. The pools are constantly accumulating debris, which can be natural or man-made.

Currently, there are several commercially available powered vacuum pump devices are capable of effectively cleaning a pool floor. However, these devices have many tubes to assemble and prime, and those that required electrical hookups present particular problems with the electrical connections. As a general rule, the known powered vacuum-type devices are complicated and require substantial time and effort to set up and dismantle. Any cleaner that requires connection to a vacuum source and/or an electric power source has inherent limitations of space and functionality. For example, crimped vacuum lines will negatively impact the cleaner's operability.

Another problem associated with known powered pool cleaners is that they often require backwashing to remove debris. Backwashing adds further to the time and effort to undergo a pool cleaning operation.

Hand held nets, known as pool "skimmers," are used by pool operators to clean leaves and other larger debris from the water surface and the pool floor. These skimmers are not difficult to set up and do not require power for operation. However, they are not very effective for removing fine debris from the pool floor and require the user to develop skill at using the net. Most have curved frames which render close contact with the floor difficult.

Automatic robot pool cleaners are also commercially available, but these are generally expensive, complicated and require power and pumping connections.

U.S. Pat. No. 3,547,458 to Price discloses a pool vacuum device with a steering attachment which provides swivel action. This type of device requires connection to a vacuum line.

U.S. Pat. No. 5,044,034 to Iannucci discloses a vacuum pool cleaner with a rotary brush. Again, this type of device is relatively complicated and requires connection to a vacuum source.

U.S. Pat. No. 4,692,956 to Kassis discloses a pool vacuum device having a vacuum hose connection and a rectangular head with a bristled perimeter.

U.S. Pat. No. 5,249,324 to Giammanco, U.S. Pat. No. Des.259,936 to Price and U.S. Pat. No. 4,835,810 to Hugo all disclose vacuum-type pool cleaners where the head is provided with wheels. All require connection to a vacuum source.

A continuing need exists for a relatively simple, inexpensive and easy to operate pool cleaning device.

SUMMARY OF THE INVENTION

An object of the present invention is to provide a pool cleaning device which does not require connection to a vacuum source or electric power source.

Another object of the present invention is to provide a pool cleaning device which is relatively easy to operate and requires no special skills.

Still another object of the present invention is to provide a pool cleaning device which is relatively simple in construction and cost effective to manufacture.

These and other objects of the present invention are met by providing a pool cleaning apparatus which includes a head having a forward portion and a rearward portion, a collection bag detachably connected to the rearward portion or the head, a deflectable blade connected to a lower end of the forward portion of the head, and being movable downwardly to engage a surface of the pool in response to water flow in the direction of the collection bag, and means for connecting a handle to the head.

Other objects, advantages and salient features of the invention will become apparent from the following detailed description, which taken in conjunction with the annexed drawings, discloses preferred embodiments of the invention.

BRIEF DESCRIPTION OF THE DRAWINGS

FIG. 11 is a schematic, side elevational view of a pool cleaning apparatus having a bag with differential mesh size according to another aspect of the present invention;

DETAILED DESCRIPTION OF THE PREFERRED EMBODIMENTS

Figure 1:
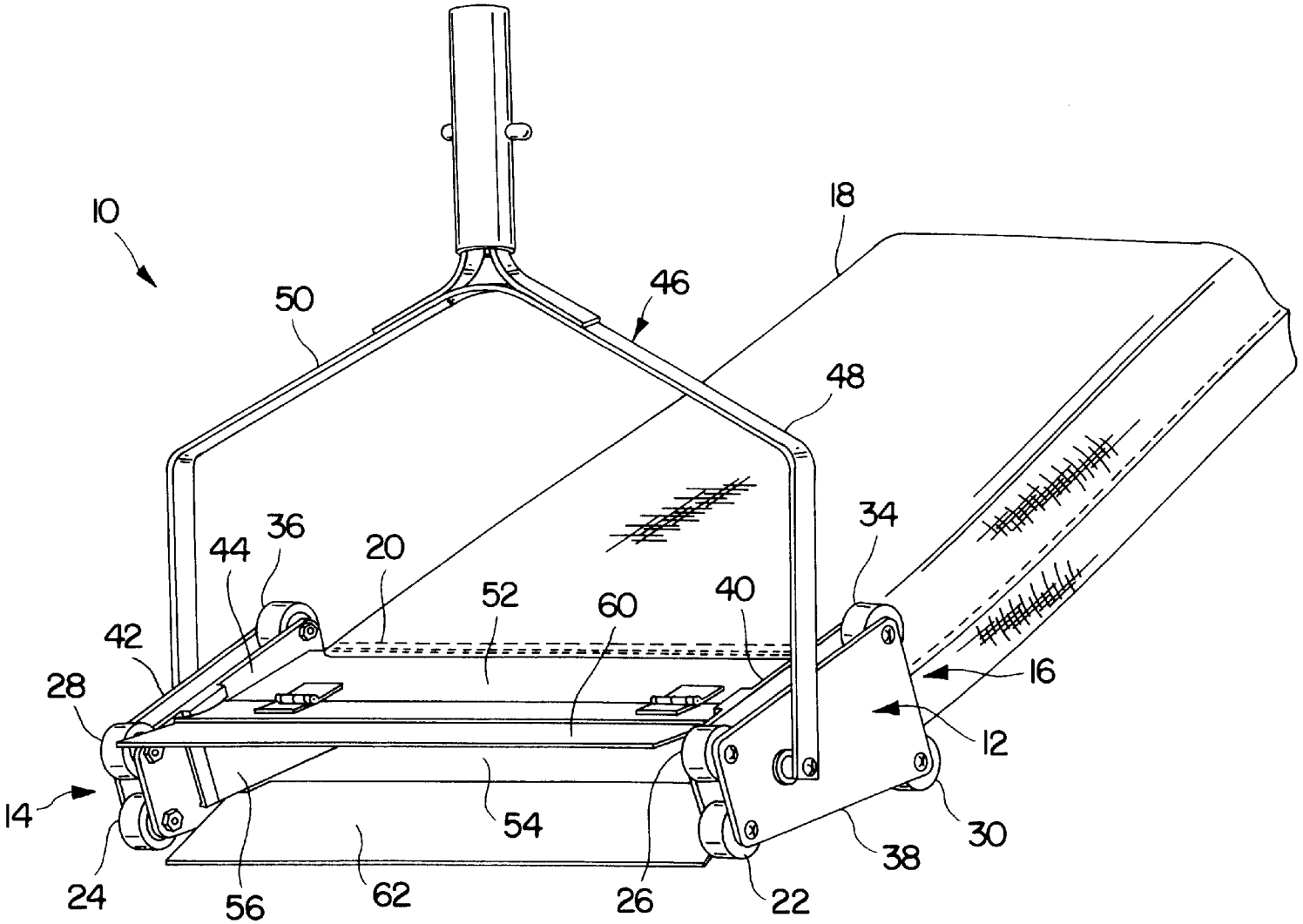
FIG. 1 is a perspective view of a preferred embodiment of a pool cleaning apparatus according to the present invention.
Figure 2:
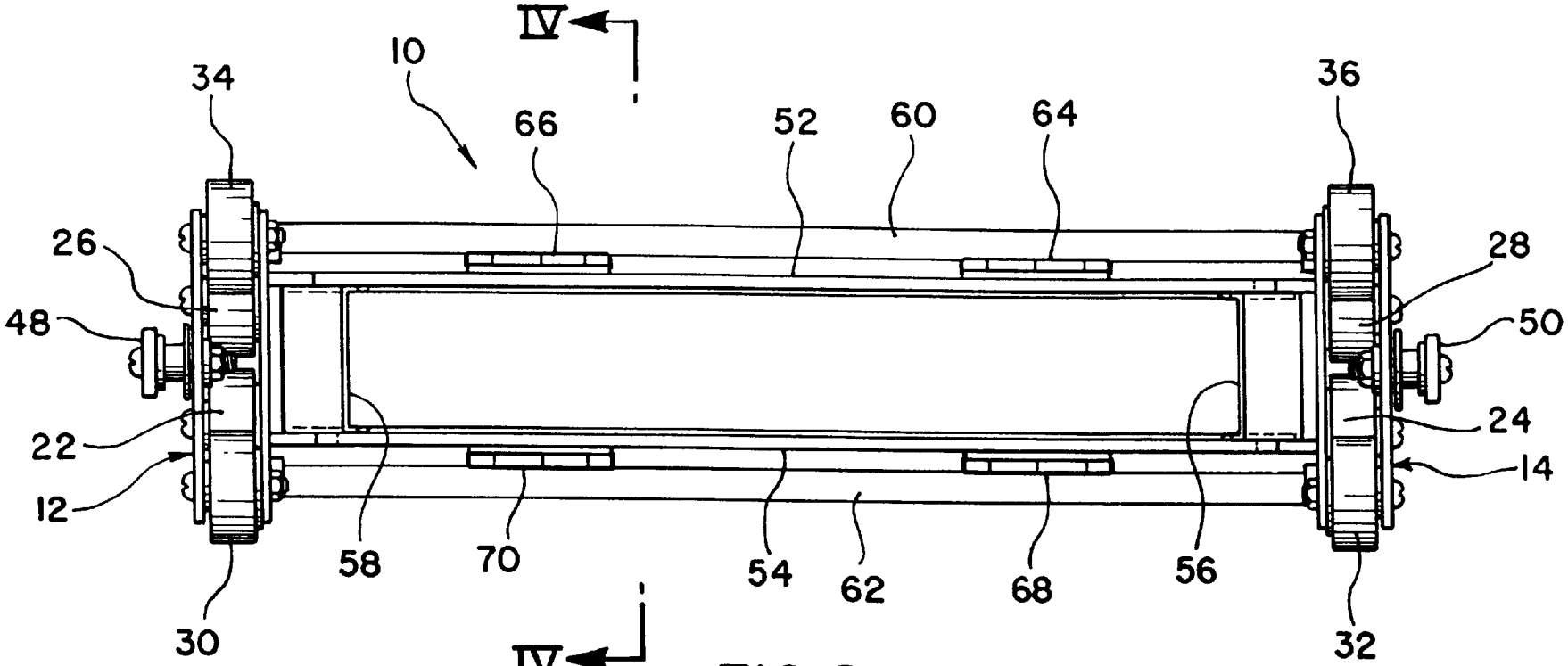
FIG. 2 is a front view of the pool cleaning apparatus of FIG. 1.
Figure 3:
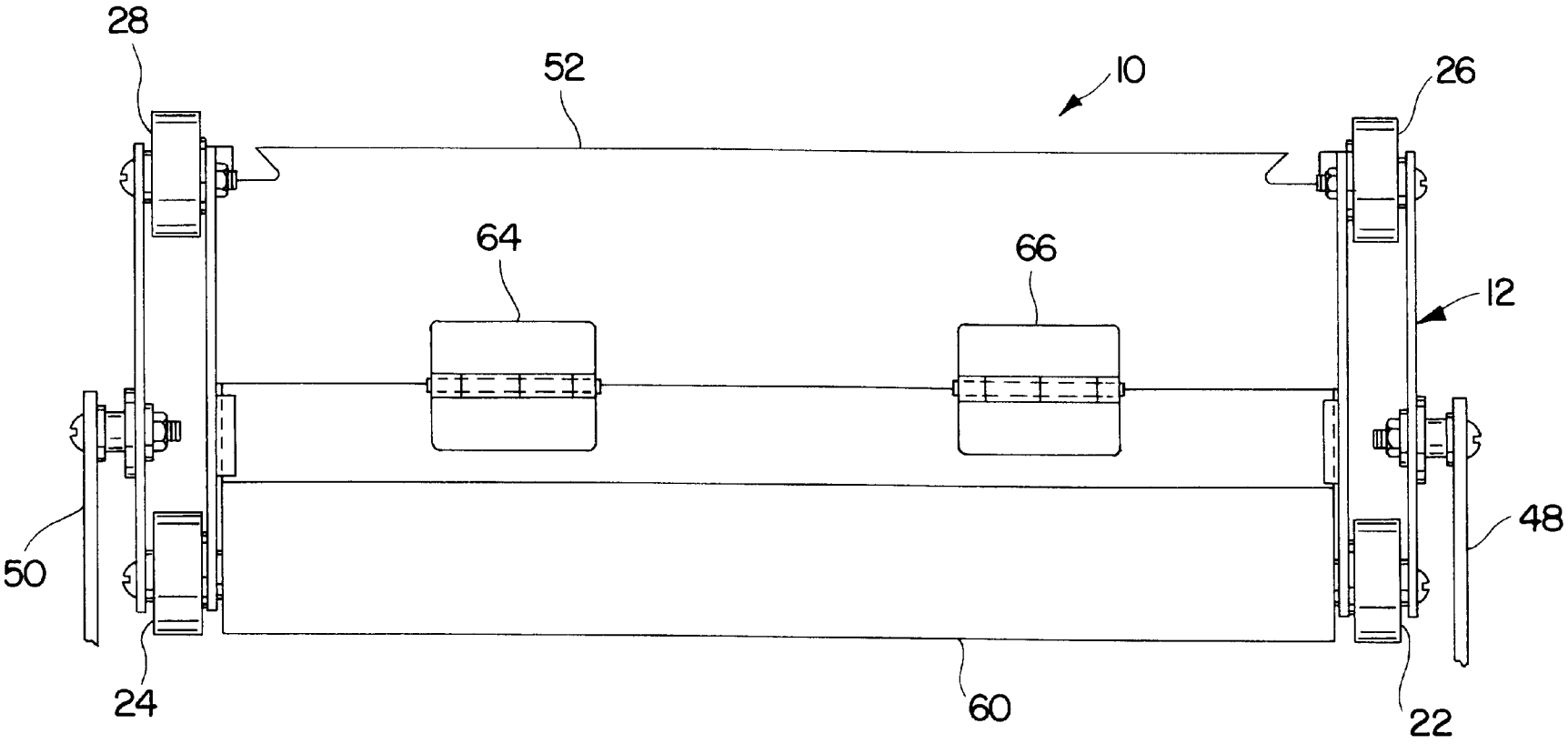
FIG. 3 is a top view of the pool cleaning apparatus of FIG. 1.

Referring to FIGS. 1–5, a pool cleaning apparatus 10 includes a head 12 having a forward portion 14 and a rearward portion 16. The head 12 is open at the forward and rearward portions to define a flow passage therethrough. A containment bag 18 is detachably connected to the open rearward portion 16 by any suitable means, such as a draw string 20. Preferably, the bag 18 is made of a mesh or screen material, such as a silk bag measuring about 10 inches wide by about 30 inches long.

The head 12 further includes two forward lower wheels 22 and 24, two forward upper wheels 26 and 28, two rearward lower wheels 30 and 32, and two rearward upper wheels 34 and 36. The wheels are journalled to freely rotate between opposite side plates 38, 40 and 42, 44. The wheels are disposed such that the head 12 can be pushed or pulled along a pool bottom or sidewalls while riding on either the upper or lower wheels. A bracket 46 is pivotally mounted to opposite sides of the head 12 and has spaced apart arms 48 and 50 are shaped to permit the head 12 to rotate therebetween to permit inversion of the head 12 in a manner to be described in more detail below.

A pair of support plates 52 and 54 extend laterally between, and are fixed connected to, the side plates 40 and 44. First and second weirs 56 and 58 are disposed on opposite sides of the head 12 between the support plates 52 and 54 and between the side plates 40 and 44 to help direct debris into the collection bag 18.

Figure 4:
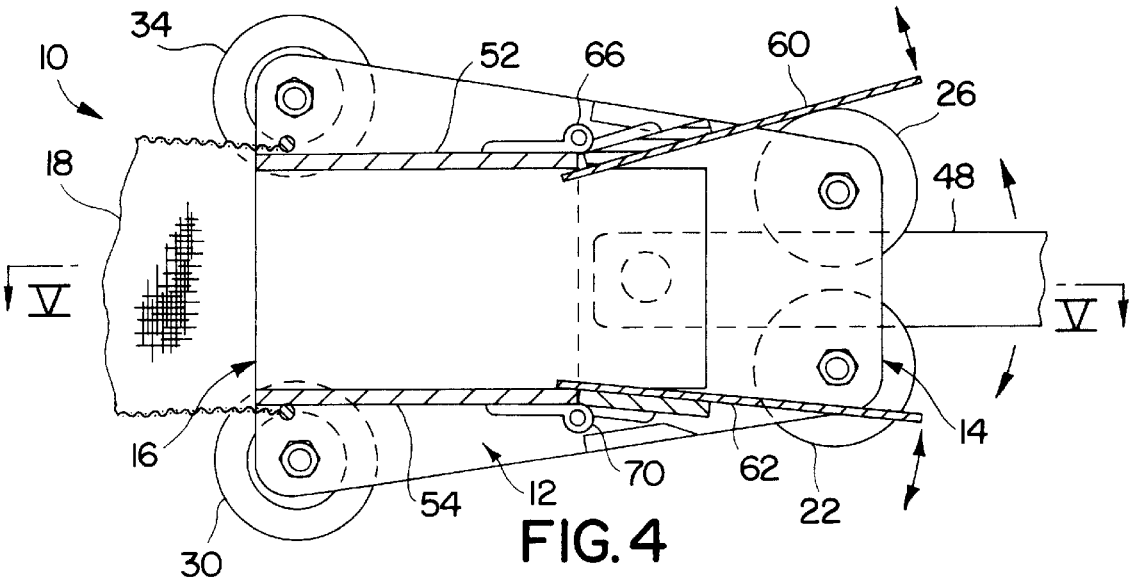
FIG. 4 is an enlarged, vertical sectional view taken along line IV—IV of FIG. 2.
Figure 5:
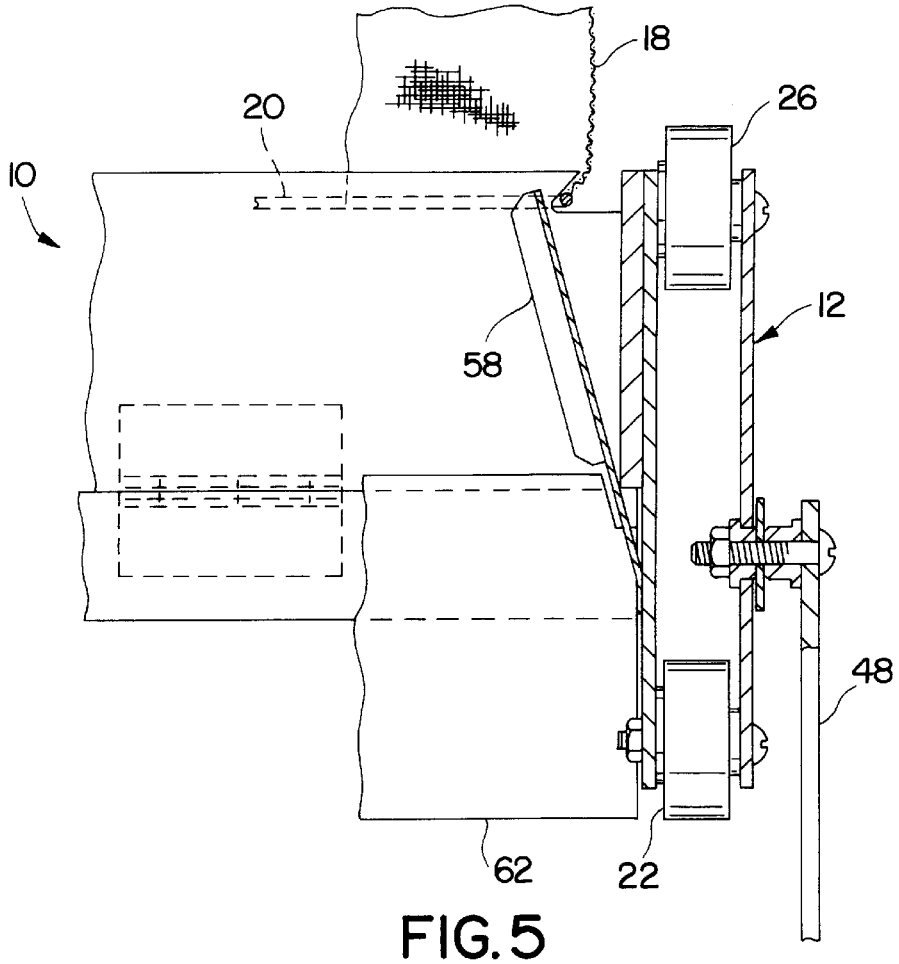
FIG. 5 is an enlarged, horizontal sectional view taken along line V—V of FIG. 4.

A pair of scraper blades 60 and 62 are pivotally connected to support plates 52 and 54, respectively, by means of hinges 64, 66 and 68, 70. The hinges do not permit the blades 60 and 62 to rotate towards each other beyond a certain point, substantially as shown in FIG. 4. However, the blades 60 and 62 are free to rotate away from each other, to resemble opening jaws, under the influence of fluid flow through the head. The blades are preferably made of a thin flexible plastic material which can engage the surface of the pool during a cleaning operation, as will be described below.

Operation

Figure 6:
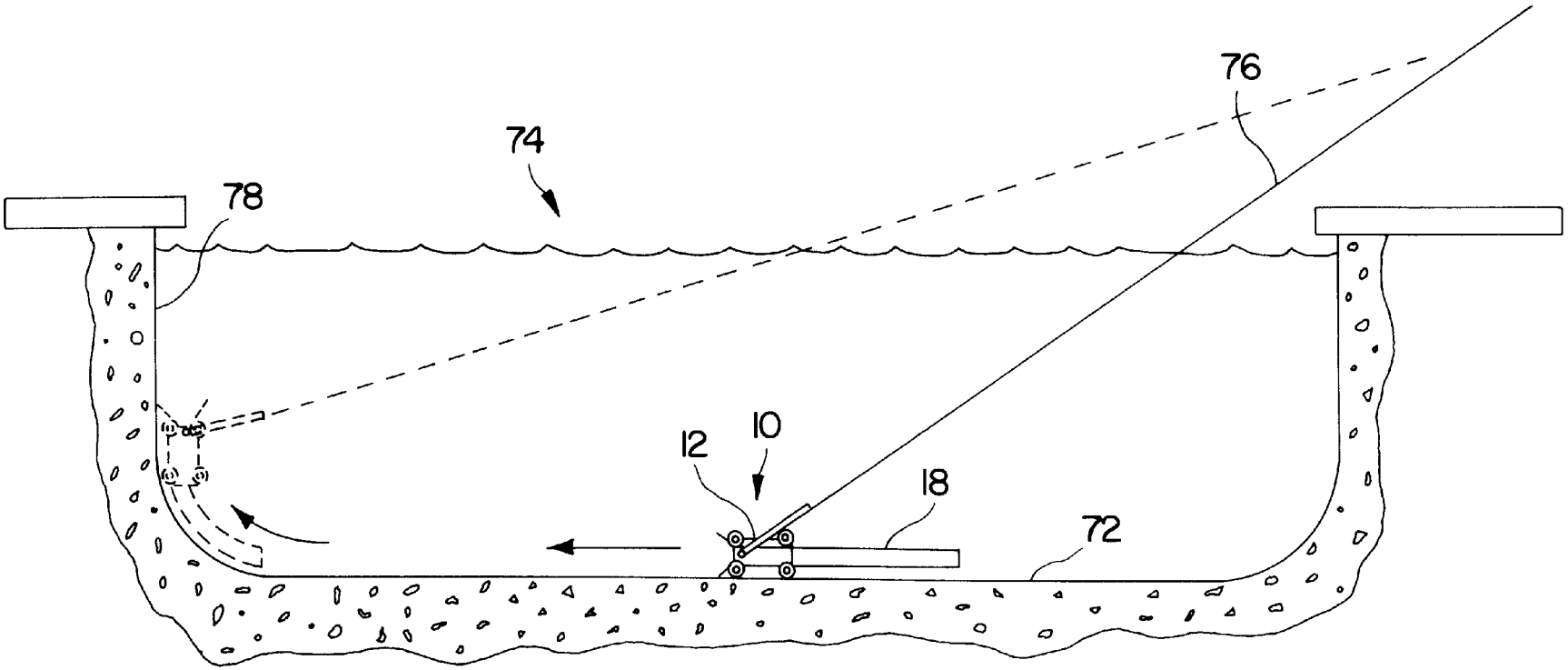
FIGS. 6 and 7 are schematic views showing operation of the pool cleaning apparatus of FIG. 1.

In FIG. 6, the pool cleaning apparatus 10 is shown in an initial position on the floor or bottom surface 72 of a pool 74. An extension pole 76 is connected to the apparatus 72 and is pushed and pulled manually by an individual. Initially, the apparatus 10 rests on the lower wheels of the apparatus. As the apparatus 10 is pushed forward, water flows through the head 12. The water movement impinges on the blades and causes same to deflect in an opening direction. As a result, the lower blade is pressed downwardly into engagement with the bottom surface 72 of the pool 74.

As shown in FIG. 6, when the head 12 approaches a sidewall 78 of the pool 74, continued forward motion of the head 12 will cause the wheels to ride up the sidewall 78 and the lower blade to engage the sidewall. Any debris on the bottom or sidewalls will be uplifted by the scraper blade, and the motion of the water will carry the debris into the collection bag 18. The apparatus in a position on the sidewall is shown in broken lines.

Figure 7:
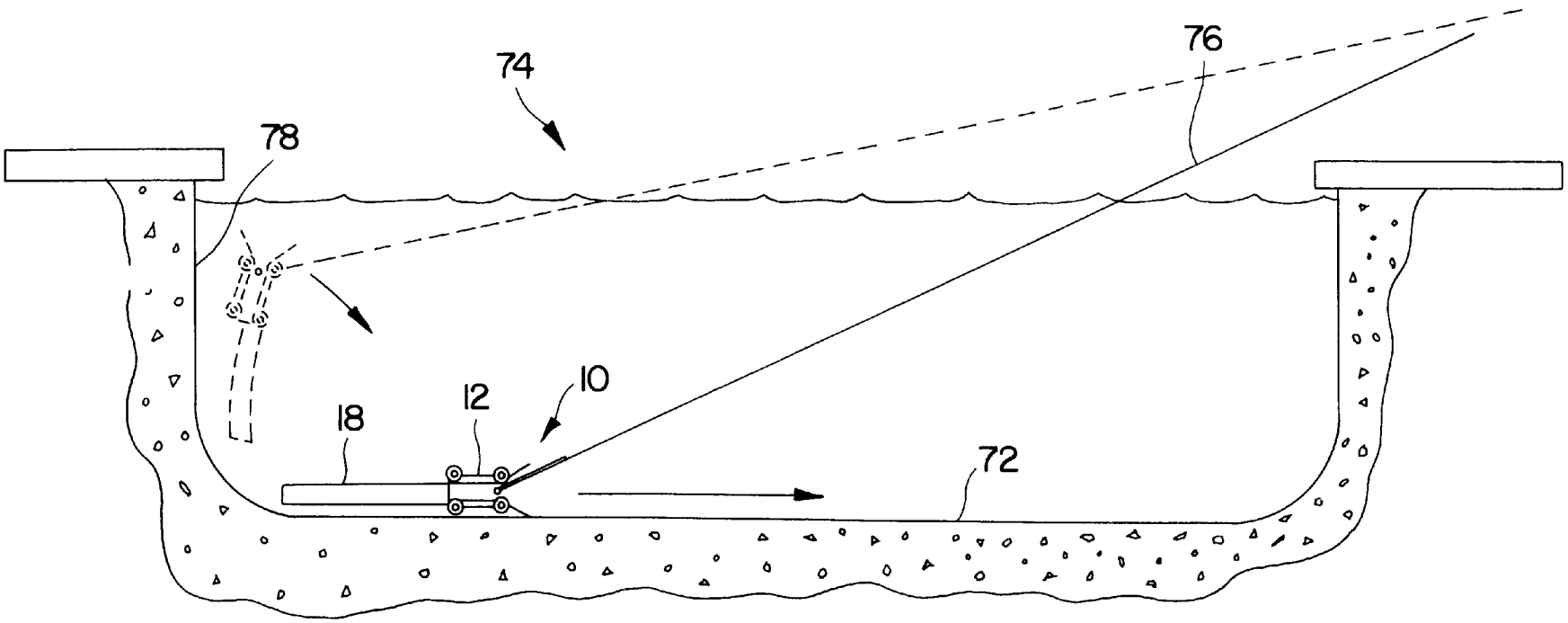

As shown in FIG. 7, to reverse direction of the apparatus 10, the head 12 is allowed to pivot between the arms of the bracket 46, as the head 12 is pulled away from the sidewall 78. When the head 12 is re-oriented on the bottom of the pool, the inverted head 12 functions in the same manner as it is pulled toward the opposite side of the pool 74. However, in this instance, the other blade is in engagement with the bottom and the upper wheels (now oriented as the lower wheels) engage the bottom.

A cleaning action would require parallel "sweeps" of the head over the bottom. While it is desirable to use successive pushing and pulling motions, it is also feasible to make successive pushing motions or pulling motions.

Additional means could be provided at the entrance of the bag to prevent backwash of collected debris from the bag when the head changes direction. Moreover, adjustable means may be provided to restrict the size of the angle defined by the two blades in the open position. Preferably, the angle is acute and relatively small so as not to create excessive drag when the head is pushed or pulled. In most embodiments, the blades move no more than about one half an inch. The blades can have a straight-edge shapes or half-moon shapes, and both can be selectively attached or detached depending on the situation. Half-moon shaped blades slide better on the pool bottom surface with crevices. In any event, the blades should be made of a material having a hardness selected to minimize abrasion of the pool surfaces to avoid damaging the surface or removing paint. For this reason, the blade are preferably detachably coupled to the support plates and can be replaced when worn.

As is apparent from the above, the apparatus picks up leaves or other types of pool debris without requiring external power. The motion of the water urges the lower blade against pool surfaces, and thus lifts the debris into the flow path of water which carries the debris into the collection bag. Fine debris can be collected in this way, in addition to larger items.

Alternative Embodiment

The embodiment describe above entails the use of water pressure, induced by water flow between the two scraper blades, to force the mouth of the cleaning apparatus open and to force the lower blade into engagement with a surface of the pool being cleaned.

Figure 8:
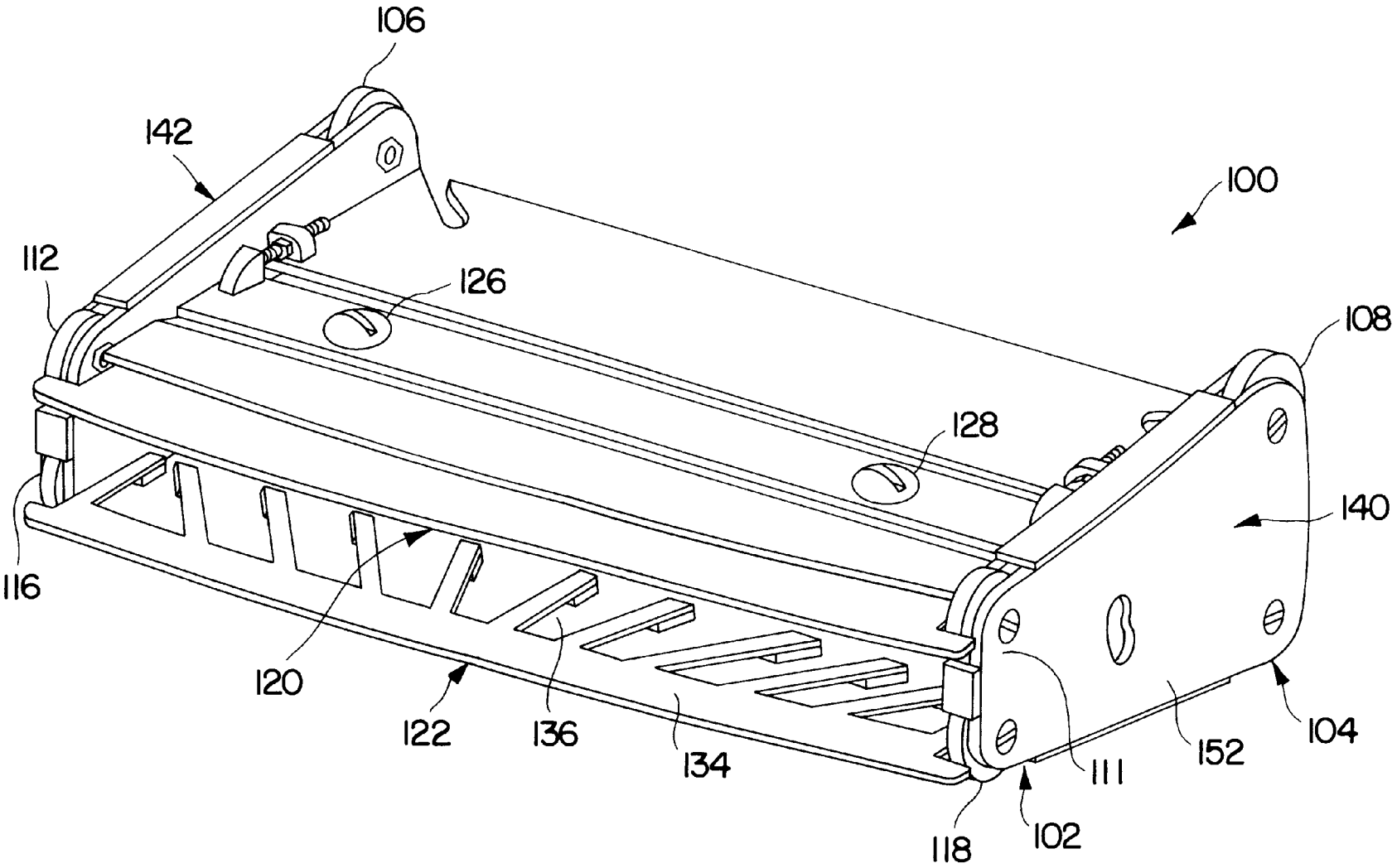
FIG. 8 is a perspective view of another embodiment of a pool cleaning apparatus of the present invention.
Figure 9:
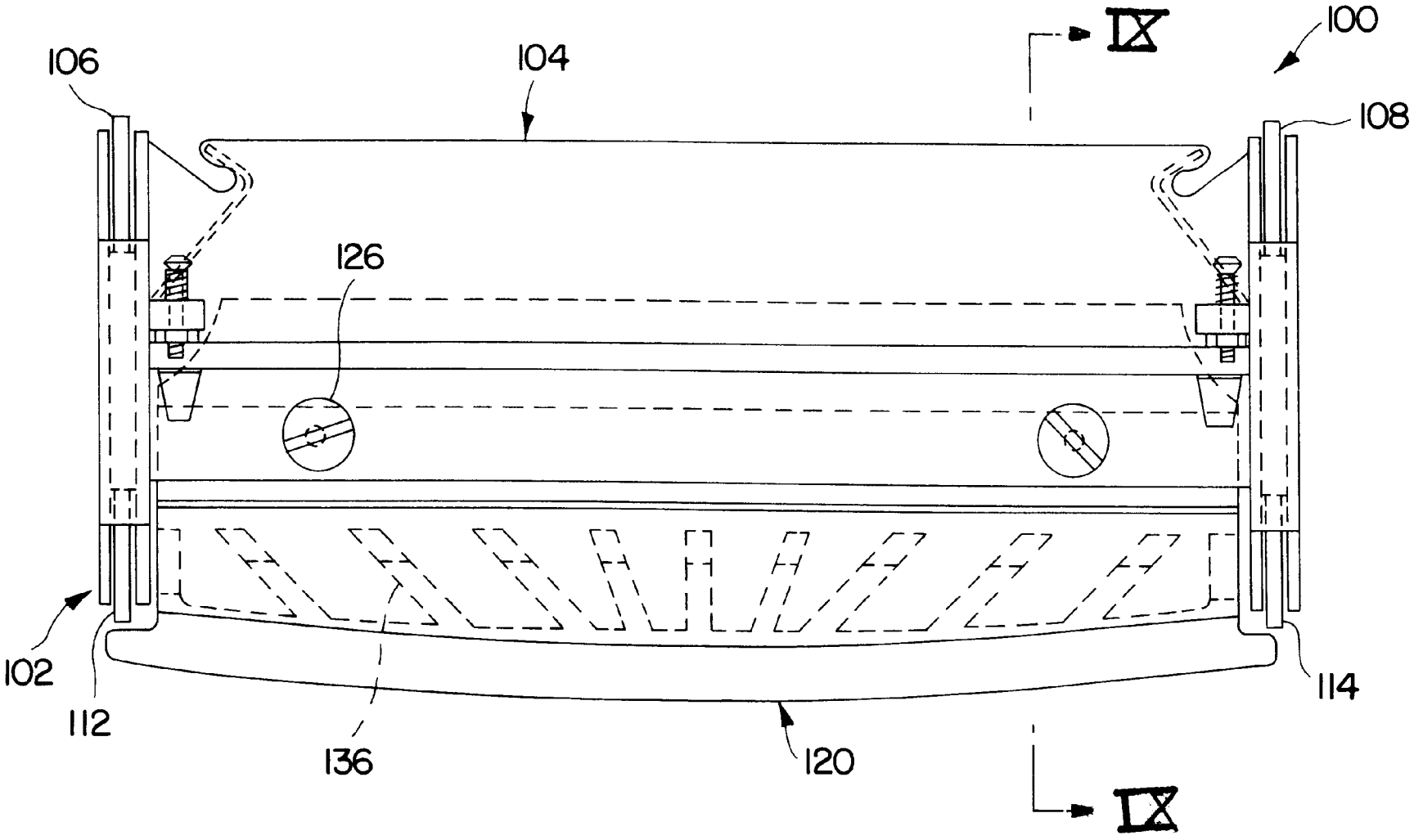
FIG. 9 is a top plan view of the pool cleaning apparatus of FIG. 8.
Figure 10:
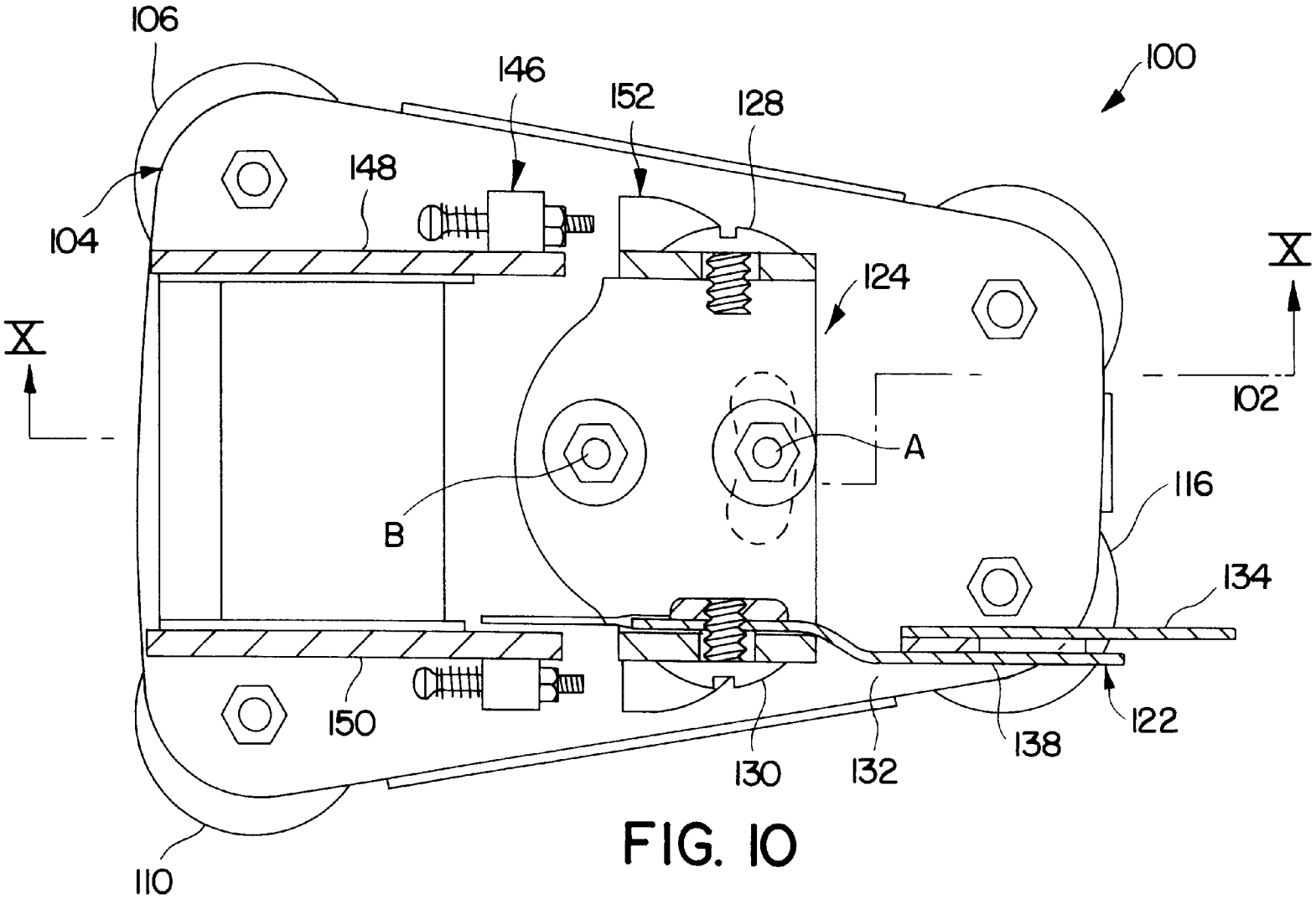
FIG. 10 is a vertical sectional view taken along line IX—IX of FIG. 9.

In a second embodiment of the invention, as shown in FIGS. 8–10, a head 100 has a forward portion 102 and a rearward portion 104. A bag (not shown) is connectable to the rearward portion 104 and detachable for the purpose of emptying the contents thereof after a cleaning operation has been completed.

As in the previous embodiment, the rearward portion 104 rotatably mounts a pair of upper wheels 106 and 108 and a pair of lower wheels, of which only wheel 110 is visible (FIG. 10). The forward portion includes a pair of upper wheels 112, 114, 116, and 118. All of the front wheels are rotatable about respective axes that a positionally fixed with respect to each other.

A pair of scraper blades 120 and 122 are distal end portions that alternately engage a pool surface, depending on the orientation of the head 100, and proximal end portions that are detachably connected to a rocker support member 124. A preferred structure for effecting detachable coupling of the blades includes screws two upper screws 126 and 128 and two lower screws, of which only screw 130 is shown (FIG. 10).

As seen in FIG. 10, the scraper blade 122 has a lower portion 132 and an upper portion 134 spaced above and staggered forwardly of the lower portion 132. A rear portion of the upper portion 134 includes a fan formation having a plurality of vanes 136. The upper portion 134 is connected to the lower portion 132 through mounting blocks 138. Alternatively, the upper portion and lower portions can be integrally formed as a single piece. Also, the upper portion 134 may be detachably connected to the lower portion.

While the foregoing description was made with reference to the lower scraper blade 122, the upper scraper blade would be identical to and interchangeable with the lower scraper blade. Both scraper blades 122 and 124 are preferably made of a rigid yet flexible plastic material and are intended to be replaceable as the forward ends of the respective upper portions wear down as the result of friction with the pool surfaces. Also, as best seen in FIG. 9, the forward edge of each scraper blade has a slightly arcuate profile, or convexity, which keeps the blade from biting the pool surface and thereby inhibiting smooth operation.

The rocker support member 124 is pivotally mounted between opposite side plates 140 and 142. The range of pivotal motion can be adjusted with adjusting means which includes adjusting screws 146, which are mounted on transverse support plates 148 and 150 which extend between the side plates 140 and 142, and stop blocks 152 mounted on upper and lower portions of the rocker support member 124.

Figure 10A:
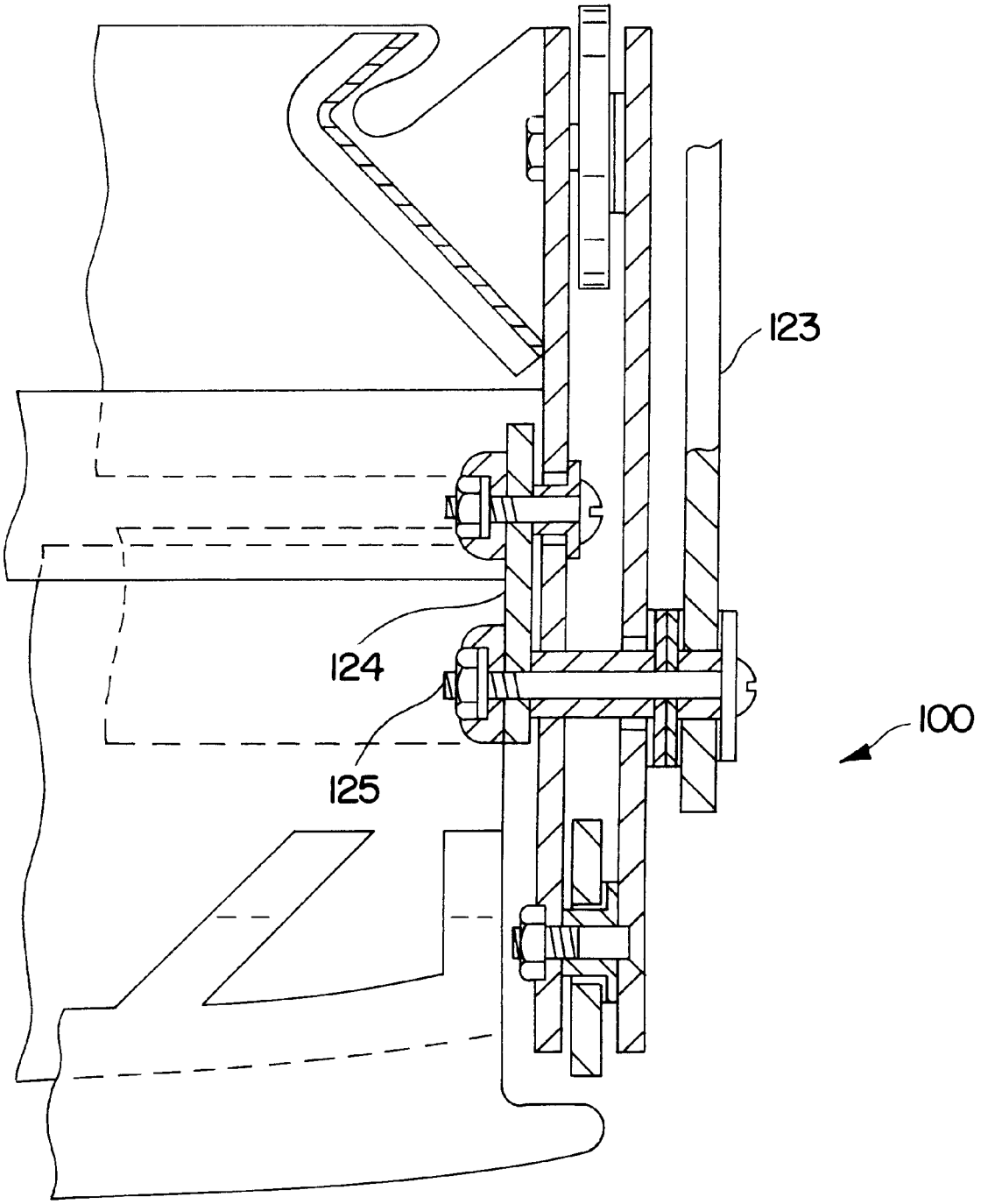
FIG. 10A is an enlarged end view, partly in section, showing the pivotal connection of the handle and rocker support member.

A handle 123 (Figure 10A), similar in all respects to the handle of the previously described embodiment, is pivotally mounted to the rocker support member 124 so that the head 100 is 360° fully rotatable on pin 125 between opposite support arms of the handle 123 and about rotation axis "A" of FIG. 10.

As the user pushes on the handle to impart forward motion of the head 100, a downward force generated by the handle and delivered at the axis A causes the rocker support member 124 to pivot downwardly (clockwise in FIG. 10) about axis "B" so that the blade 122 engages the pool surface. The mounting pins of the handle move downwardly by virtue of arcuate slots formed in the side plates 140 and 142. Only slot 152 on the right-hand side of the head 100 is visible in FIGS. 8 and 10.

Unlike the previous embodiment, the force that urges the blades into engagement with the pool surface is a torque generated by the handle. The torque results from the fact that the handle is connected to the rocker support member 124 at a point forward of the pivot point B where the rocker support member 124 is connected to the side plates 140 and 142.

The point A of pivotal connection is also significant because it is a balance point so that when the apparatus is placed in a pool, the head 100 descends in the orientation shown in FIG. 10 and will thus rest on the lower forward and rearward wheels.

Another aspect of the present invention is the use of a bag that has differential mesh size, or hole size, so that the mesh gets finer towards the rear of the bag. The larger mesh or holes encourages water flow through the bag because with uniformly small mesh, a flow restriction causes debris to be pushed out of the way of the mouth of the head as the head moves through the water.

Figure 11:
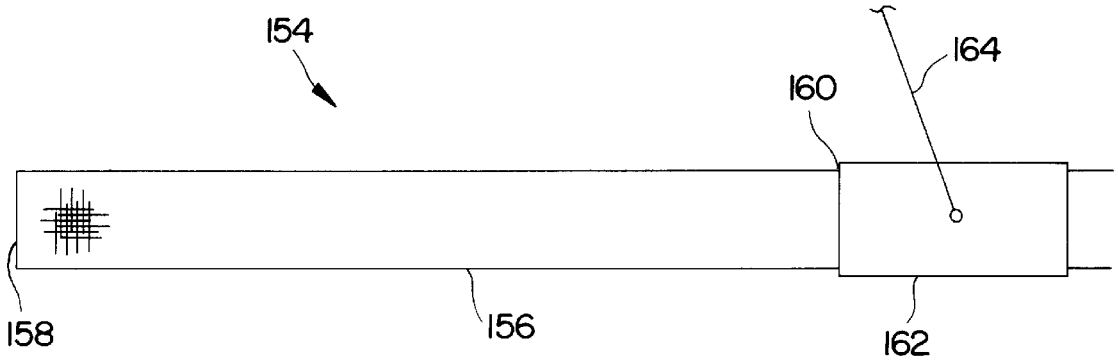
FIG. 11 is a sectional view taken along line X—X of FIG. 10.
Figure 12:
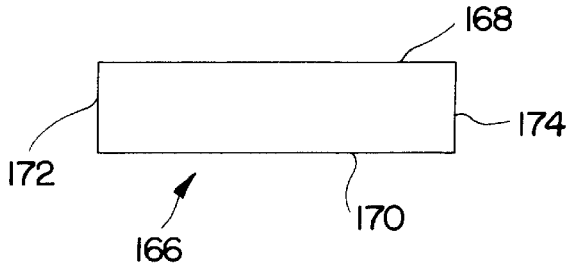
FIG. 12 is an end view of a bag according to the present invention.

An example is shown in FIGS. 11 and 12. FIG. 11 shows a pool cleaning apparatus 154 which includes a bag 156 having a closed rearward end 158 and an open forward end 160 which is detachably connected to a rearward portion of a head 162. A handle 164 is pivotally connected to the head 162 in a manner as described above. The mesh size of the bag 156 is such that a finer mesh is provided at the rearward end 158 and a larger mesh is provided at the forward end. This helps create a draw that encourages water flow and debris into the bag. The change in mesh size may be continual from front to rear or may be in discrete jumps. The change in mesh size could also be effected by starting with a bag of a particular fine mesh size and then forming holes of larger mesh size in the upper and lower surfaces of the bag.

Figure 13:
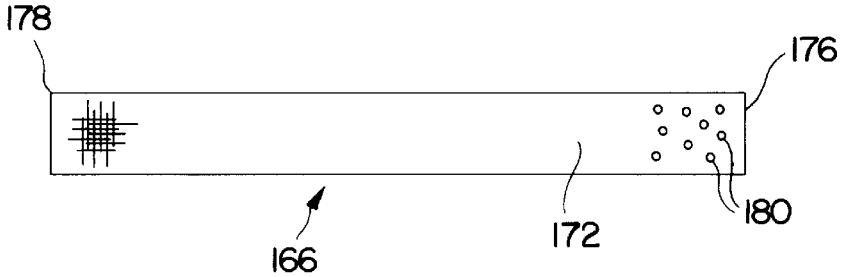
FIG. 13 is a side elevational view of the bag of FIG. 12.

As seen in FIGS. 12 and 13, a bag 166 has an upper sheet 168 of mesh material, a lower sheet 170, opposite side wall sheets 172 and 174, a forward end 176 and a rearward end 178. Holes 180 may be formed in the side wall sheets 172 at the forward end 176 to implement the differential mesh size aspect of the present invention. These holes may be holes or just larger mesh material as compared to either the mesh of the upper and lower sheets, and/or the mesh of the rear portions of the side wall sheets and/or upper and lower sheets.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A pool cleaning apparatus comprising:

a head having a forward portion and a rearward portion;

a mounting block pivotally mounted in the head and being pivotal about a pivot axis;

a pair of scraper blades connected to the mounting block; and means for pivotally connecting a handle to the mounting block at a point spaced from the mounting block pivot axis, whereby the scraper blades are caused to pivot towards a pool surface by a force applied to the handle.

2. An apparatus according to claim 1, further comprising a debris reservoir detachably connected to the rearward portion of the head.

3. An apparatus according to claim 2, wherein the debris reservoir is a bag having differential mesh size.

4. An apparatus according to claim 3, wherein the bag has a forward open end and a closed rearward end, and the mesh is larger at the forward end relative to the mesh at the rearward end.

5. An apparatus according to claim 1, wherein each scraper blade has an arcuately shaped forward edge.

6. An apparatus according to claim 1, wherein each scraper blade is detachably connected to the mounting block.

7. An apparatus according claim 1, further comprising means for adjusting a range of pivotal motion imparted to the mounting block.

* * * * *